US006378707B1

(12) United States Patent
Taggert

(10) Patent No.: US 6,378,707 B1
(45) Date of Patent: Apr. 30, 2002

(54) KNOCK-DOWN BOOKSHELF

(76) Inventor: Roger A. Taggert, 231 N. Point Ave., Apt. I, High Point, NC (US) 27262

( * ) Notice: Subject to any disclaimer, the term of this patent is extended or adjusted under 35 U.S.C. 154(b) by 0 days.

(21) Appl. No.: 09/628,113

(22) Filed: Jul. 27, 2000

(51) Int. Cl.[7] ..... A47B 65/00
(52) U.S. Cl. ..... 211/42; 211/186; D6/475
(58) Field of Search ..... 211/42, 43, 186, 211/41.1, 41.2, 40, 41.3, 135, 126.6, 132.1, 41.15, 41.9, 41.5, 41.6; D6/475

(56) References Cited

U.S. PATENT DOCUMENTS

| | | | | | |
|---|---|---|---|---|---|
| 1,066,030 | A | | 7/1913 | Mello | |
| 1,130,096 | A | | 3/1915 | McSheehy | |
| 1,477,634 | A | | 12/1923 | Connor | |
| 1,545,994 | A | * | 7/1925 | Anderson | 211/41.1 |
| 1,611,432 | A | | 12/1926 | Gladstone | |
| 1,886,532 | A | * | 11/1932 | Davidson | 211/137 |
| 1,923,996 | A | | 8/1933 | Oldenbusch | |
| 2,001,139 | A | | 5/1935 | Johnson | |
| 2,051,448 | A | | 8/1936 | Johnson | |
| 2,062,165 | A | * | 11/1936 | Davidson | 211/137 |
| 2,096,634 | A | | 10/1937 | Gilbert | |
| 2,142,713 | A | | 1/1939 | Campbell | |
| 2,279,864 | A | * | 4/1942 | Eide | 211/184 |
| 2,366,421 | A | | 1/1945 | Nelson | |
| D164,452 | S | | 9/1951 | Schiffer | |
| D168,420 | S | | 12/1952 | Pinkham | |
| 2,843,439 | A | | 7/1958 | Parker | |
| D190,587 | S | | 6/1961 | Magers | |
| 3,069,216 | A | * | 12/1962 | Vaeth | 312/195 |
| 3,139,255 | A | * | 6/1964 | Palm | 248/150 |
| 3,164,254 | A | | 1/1965 | Gorc | |
| 3,297,164 | A | | 1/1967 | Hutchinson | |
| 3,387,713 | A | | 6/1968 | Brooks | |
| 3,464,565 | A | * | 9/1969 | Nevai | 211/42 |
| 3,661,269 | A | | 5/1972 | Scherzer | |
| 3,817,393 | A | | 6/1974 | Nelisen | |
| 4,002,240 | A | | 1/1977 | Dorn | |
| 4,073,460 | A | | 2/1978 | Dale | |
| 4,105,182 | A | | 8/1978 | Jacobson | |
| 4,140,065 | A | * | 2/1979 | Chacon | 108/156 |
| 4,153,311 | A | * | 5/1979 | Takahashi | 312/107 |
| 4,383,722 | A | | 5/1983 | Weber | |
| 4,567,834 | A | | 2/1986 | Pyka | |
| 4,611,720 | A | | 9/1986 | Staub | |
| 4,832,421 | A | * | 5/1989 | Shoffner | 312/263 |
| 5,012,937 | A | * | 5/1991 | Owens | 211/189 |
| 5,036,988 | A | | 8/1991 | Rouire | |
| 5,145,134 | A | | 9/1992 | Hashimoto et al. | |
| 5,259,578 | A | * | 11/1993 | Jones et al. | 248/174 |
| 5,277,388 | A | * | 1/1994 | Denaro | 248/152 |
| 5,301,820 | A | | 4/1994 | Rossmoore | |

(List continued on next page.)

FOREIGN PATENT DOCUMENTS

| | | |
|---|---|---|
| DE | 3310319 C1 | 8/1984 |
| FR | 35206 | 12/1929 |
| FR | 793578 | 11/1935 |
| FR | 1162358 | 9/1958 |
| IT | 526776 | 5/1955 |
| JP | 54-44931 | 4/1979 |
| JP | 405168532 A | 7/1993 |
| SE | 132270 | 7/1951 |

*Primary Examiner*—Daniel P. Stodola
*Assistant Examiner*—Khoa Tran
(74) *Attorney, Agent, or Firm*—Siemens Patent Services

(57) ABSTRACT

There is provided a knock-down bookshelf having a pair of trapezoidal base members each having front and rear slots which interlock with corresponding slots in front and rear vertical panels. When assembled, these members form a rigid base which supports a horizontal platform at a slight rearward slope so that books or similar articles placed on the horizontal platform are supported by the rear vertical panel without need for bookends or similar retaining devices. The bookshelf may be easily assembled and disassembled without need for tools.

13 Claims, 3 Drawing Sheets

U.S. PATENT DOCUMENTS 5,480,118 A 1/1996 Cross
5,516,072 A 5/1996 Shinno
5,853,154 A 12/1998 Ashley
5,974,707 A * 11/1999 Kowalczyk ..... 40/124.4
D419,339 S * 1/2000 Taggert ..... D6/475
6,170,674 B1 * 1/2001 Caterinacci ..... 211/41.1
6,186,343 B1 * 2/2001 Brown ..... 211/40

* cited by examiner

KNOCK-DOWN BOOKSHELF

CROSS REFERENCE TO RELATED APPLICATIONS

The present application is related to previous U.S. application Ser. No. 09/024,149, filed on Feb. 1, 1998, now abandoned.

BACKGROUND OF THE INVENTION

1. Field of the Invention

The present invention relates to the publishing industry, especially as it relates to the leisure reader and the storage of books. More particularly, the invention comprises a knock down bookshelf which is easily transportable and capable of holding a number of books in a stable, upright posture without the aid of external supporting devices.

2. Description of the Prior Art

Shelves for books and other items which are stored or displayed in a similar manner have been in existence for centuries and come in many sizes and descriptions.

U.S. Pat. No. 2,843,439, issued to James Parker on Jul. 15, 1958, relates to a book support wherein books are stored in a horizontal position, spine upward, resting on arcuate ribs conforming roughly to the shape of the face of the pages of the closed books, so as to preserve the natural shape of the books. Unlike the present invention, Parker's book support is of a semi-stationary nature resting on the floor and cannot be used as a portable, desktop bookshelf.

Italian Patent number 526,776, issued to Enzo Lullini a Firenze on May 21, 1955, relates to a wire framed bookshelf wherein books are stored in an upright fashion, resting on a planer surface, tilted down to the rear, with vertical end supports and a back support perpendicular to the plane of the shelf. Lullini's bookshelf is portable and designed for desktop use, but, unlike the present invention, it can not be disassembled for storage or travel.

U.S. Pat. No. 4,073,460, issued to Richard Dale on Feb. 14, 1978, relates to stand for a calculator comprising a rectilinear inclined planar surface supported on its rear edge by a butt flange to elevate the surface plane from the horizontal, and with a lip flange along the front edge of the surface plane to hold a calculator in place. Unlike the present invention, Dale's calculator stand is not suitable for use as a bookshelf.

U.S. Pat. No. Des 164,452, issued to Samuel S. Schiffer on Sep. 4, 1951, relates to a rack wherein a longitudinal planar support platform is abutted by a back and an end which are perpendicular to the support platform. The entire rack structure is elevated at one end to create raise one corner of the support platform in such a way as to shift it from horizontal along both its length and depth. Schiffer's rack could be used as a desktop bookshelf, but unlike the present invention, it can not be disassembled for storage or travel.

French Patent number 793,578, issued to M. Francois Springuel on Jan. 27, 1936, refers to a book rack comprising a pair of planar surfaces joined at approximately a 90° and supported at their juncture by a legs such that each plane is approximately 45° from the horizontal. By the nature of the design, Springuel's book rack is suited for desktop use, but unlike the present invention is can not be disassembled for storage or travel.

Japanese Patent number 54-44931, issued to Toshikazu Matsuura on Apr. 9, 1979, relates to a system of bookshelves wherein smaller three smaller bookshelves, each with bookends, are disposed at the front and rear parts of a larger shelf, each smaller shelf being of something less than half the length and width of the larger shelf. In this system, books may more easily be arranged among the smaller shelves, which may then be shifted around on the larger shelf into a logical arrangement. This system is designed for a library situation and, unlike the present invention is not easily portable.

U.S. Pat. No. 5,036,988, issued to Michel Rouire on Aug. 6, 1991, relates to a metal bookend for metal shelves. Rouire's bookend is of the typical single piece metal bookend created by cutting the perimeter of the base plate from the center of the vertical plate, the bottom of the vertical plate attached, and making a bend along the attachment, with the weight of the books sitting on the base plate holding the bookend in place. Rouire's improvement over the typical was a strip magnet incorporated into the base plate to hold the bookend to the metal shelf magnetically. Rouire is not a bookshelf in its own right, as the immediate invention, nor can it be folded flat for storage on travel.

None of the above inventions and patents, taken either singly or in combination, is seen to describe the instant invention as claimed.

SUMMARY OF THE INVENTION

To one who frequently reads or makes reference to a number of books on a regular basis, arrangement and storage of his books frequently becomes a problem. This is especially true of the reader who travels frequently, finds himself in the situation of relocating frequently, or just has a limit space in which to store and display books.

The present invention presents a bookshelf which may quickly and easily be assembled, used for desktop storage and display, wherein the books can stand with only the aid of the bookshelf, then quickly and easily disassembled for storage or travel.

Accordingly, it is a principal object of the invention to provide a bookshelf that is compact for storage or travel.

It is another object of the invention to provide a bookshelf which can be easily assembled, without the aid of tools.

It is a further object of the invention to provide a bookshelf which will support a book, leaning against the near vertical end piece, without the additional aid of bookends.

Still another object of the invention is to provide a bookshelf which will support a plurality of books, the first leaning against the near vertical end piece and each successive book leaning against the previous, without the additional aid of bookends.

An additional object of the invention is to provide a bookshelf which is easily and quickly disassembled, without the aid of tools, for storage or travel.

It is again an object of the invention to provide a bookshelf which is economical to produce and market.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

To one who frequently reads or makes reference to a number of books on a regular basis, the convenient arrangement and storage of his books frequently becomes a problem. This is especially true of the reader who travels frequently, finds himself in the situation of relocating frequently, or just has a limit space in which to store and display books.

Figure 1:
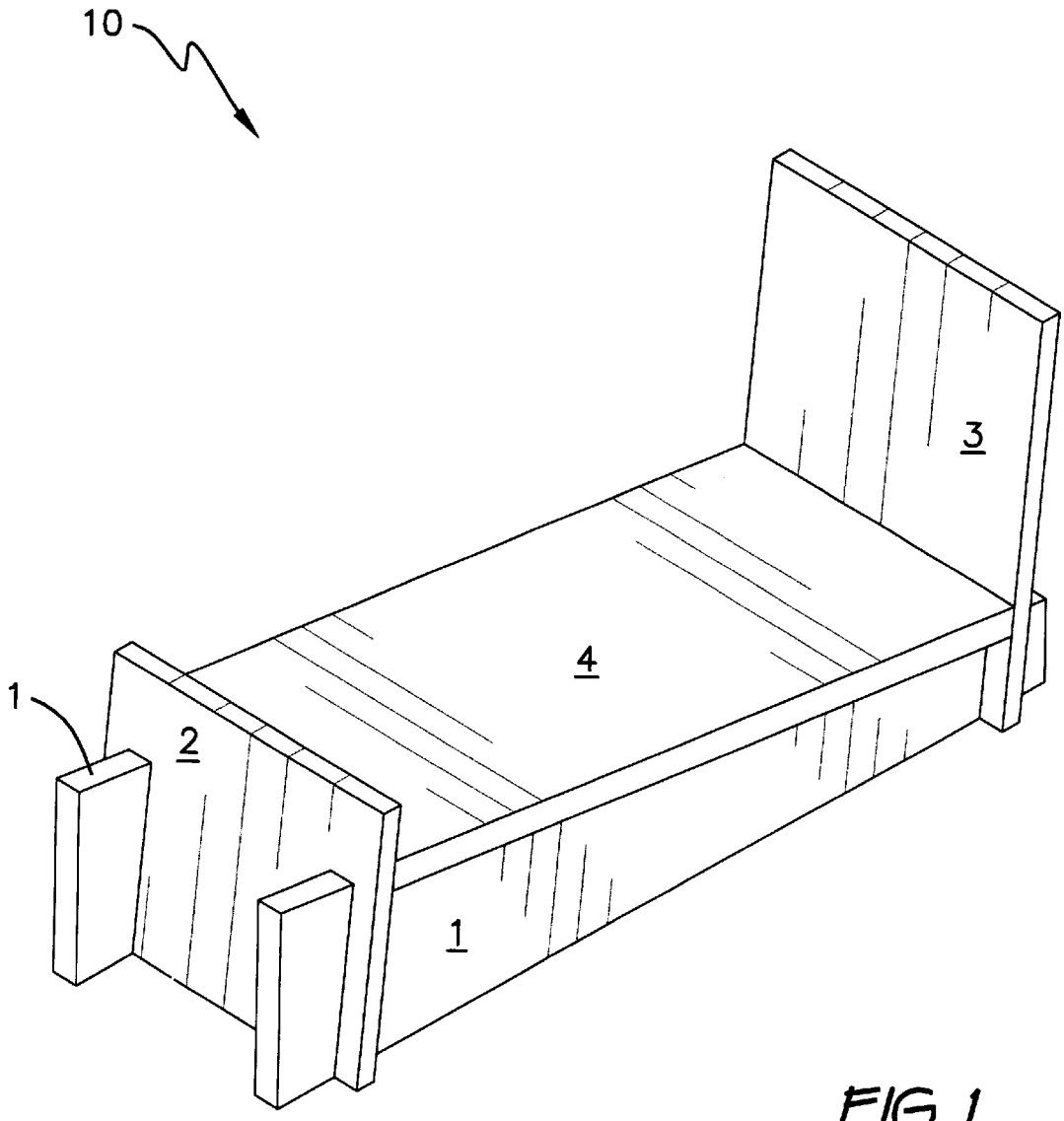
FIG. 1 is an environmental perspective of the invention.

The present invention, as displayed in FIG. 1 fulfills the needs of the mobile reader by providing a bookshelf with an elongated planar surface, higher at one end and sloping downwardly toward a perpendicular support.

Figure 2:
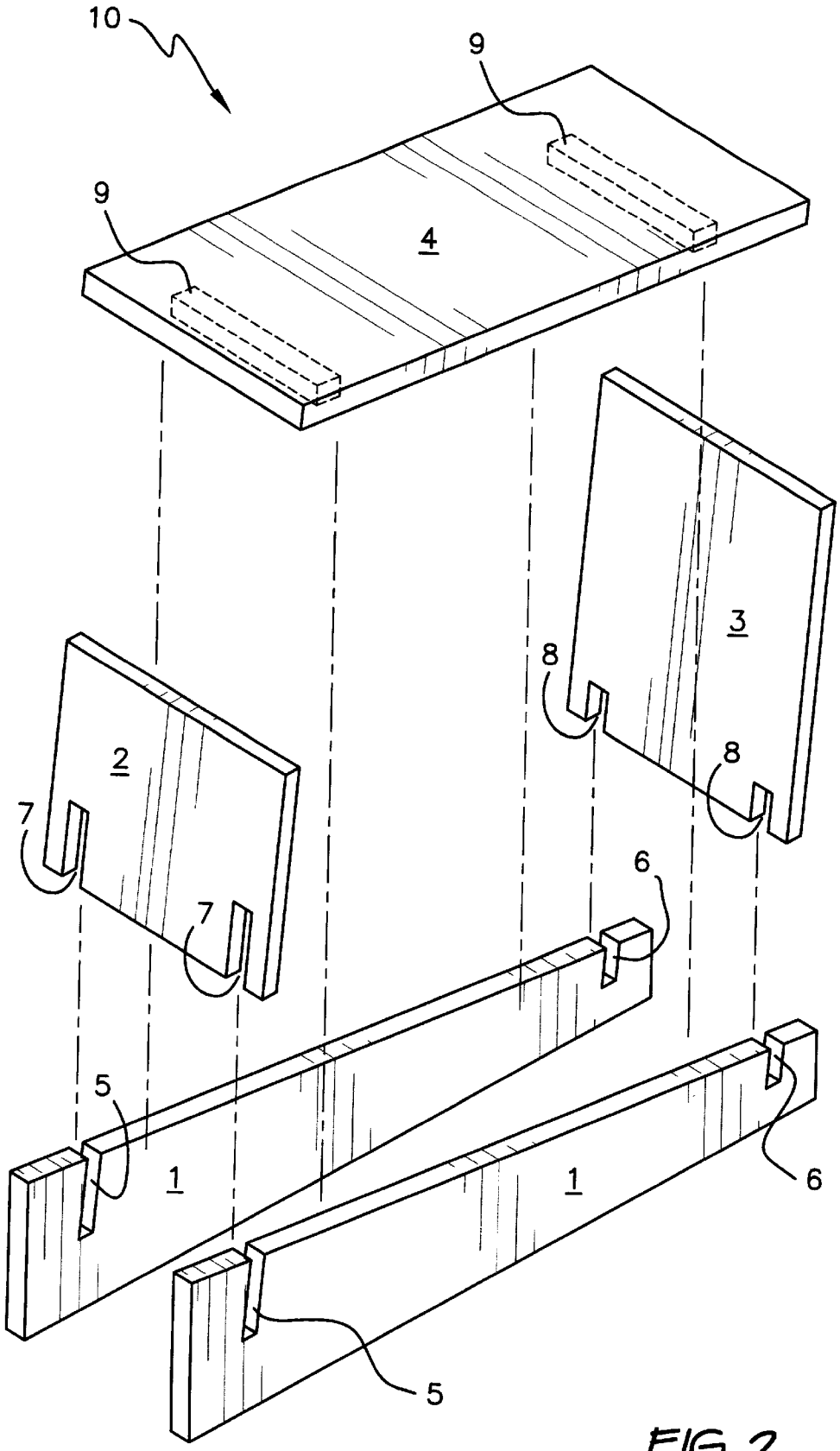
FIG. 2 is an exploded perspective of the invention.

FIG. 2 provides an exploded view of knock-down bookshelf 10, comprising a pair of matching base panel 1, front panel 2, rear panel 3, and base plate 4.

Base panel 1 a trapezoidal plane such that its end proximate front panel 2 is higher than its end proximate rear panel 3, providing a rearwardly sloping base for base plate 4. Proximate each end of base plate 1, perpendicular to the upper edge thereof and running from the upper edge thereof are notch 5 and 6, each a cut equal to half the height of base panel 1 at that point.

Front panel 2 is a generally rectangular plane, its width being the longer dimension, slightly taller in height than is base panel 1 at their point of intersection. Proximate each end of front panel 2, perpendicular to the lower edge thereof and running from the lower edge thereof are notch 7, a cut of half the height of front panel 2.

Rear panel 3 is a generally rectangular plane, its width being equal to that of front panel 2 and its height being approximately 2 to 3 times that of front panel 2. Proximate each end of rear panel 3, perpendicular to the lower edge thereof and running from the lower edge thereof are notch 8, a cut of half the height of base panel 1 at its point of juncture with rear panel 3. Notches 5, 6, 7, and 8 each have a width equal to the thickness of the material of their intersecting component.

Base plate 4 is a rectangular plane having a width equal to that of front panel 2 and rear panel 3 and a length equal to the distance between front panel 2 and rear panel 3. Affixed to the under side of base plate 4 are a pair of cleats 9 situated such that they will fit between base panels 1 to prevent base plate 4 from sliding horizontally between base panels 1.

In assembling knock-down bookshelf 10, notches 7 of front panel 2 are engaged into notches 5 of base panels 1; notches 8 of rear panel 3 are engaged into notches 6 of base panels 1; and base plate 4 is fitted between front panel 2 and rear panel 3 with cleats 9 fitted between base panels 1.

Figure 3:
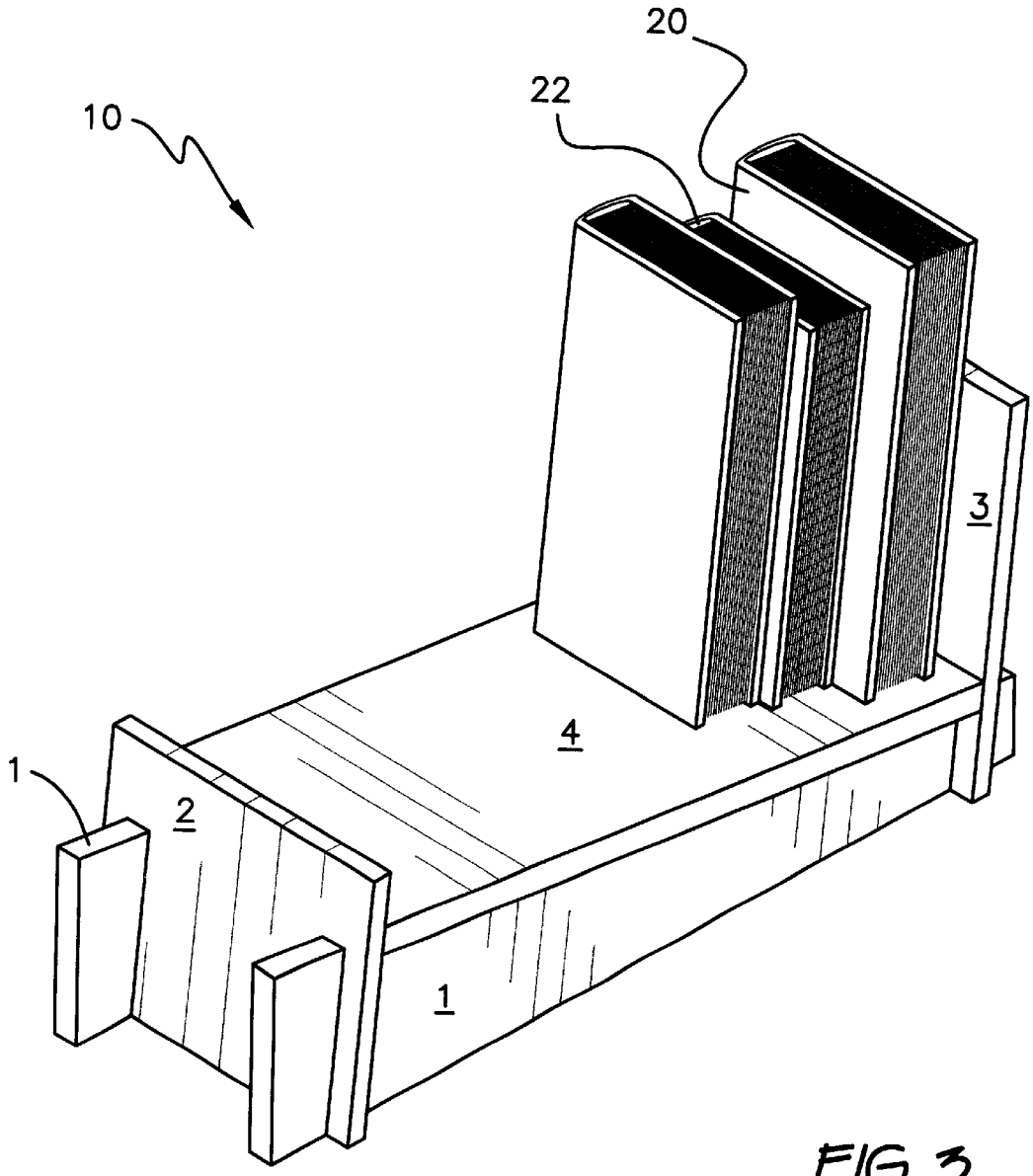
FIG. 3 is an environmental perspective of the invention in its intended use of displaying books.

As in FIG. 3, book 20 is placed on base plate 4, in an upright position, with the cover of the book 20 resting against rear panel 3. Subsequent book(s) 22 are placed on base plate 4, in an upright position, with the cover of the first subsequent book 22 resting against book 20 and each subsequent book 22 resting against the each previous book 22, in order.

It would be evident to one skilled in the art that knock-down bookshelf could be produced of a number of different materials, i.e. wood, plastic or metal.

It would also be evident that styling could be varied in a number of different ways, i.e. arched front and rear panels, cutout designs, etc.

It is to be understood that the present invention is not limited to the embodiments described above, but encompasses any and all embodiments within the scope of the following claims.

I claim:

1. A knock-down bookshelf, comprising:

a) a pair of substantially planar base panels each having a front edge, a rear edge, a top edge and a bottom edge, said front edges and said rear edges being substantially parallel, said front edges being longer than said rear edges, said base panels each comprising a front notch disposed it said top edge thereof proximate said front edge thereof and a rear notch disposed in said top edge thereof proximate said rear edge thereof, said front and said rear notches each being substantially perpendicular to said top edge of said base panels;

b) a substantially rectangular planar front panel having top, bottom, left and right edges, said front panel having a left notch in said bottom edge thereof proximate said left edge thereof and a right notch in said bottom edge thereof proximate said right edge thereof, said left and said right notches being disposed substantially perpendicular to said bottom edge of said front panel, said left and said right notch each being adapted for slidable connection with said front notch of a first and a second of said pair of base panels, respectively;

c) a substantially planar rear panel having top, bottom, left and right edges, said rear panel having a left notch in said bottom edge thereof proximate said left edge thereof and a right notch in said bottom edge thereof proximate said right edge thereof, said left and said right notches each being disposed substantially perpendicular to said bottom edge of said rear panel, said left and said right notch each being adapted for slidable connection with said rear notch of said first and said second of said pair of base panels, respectively; and d) a substantially rectangular planar base plate disposed on said top edges of said pair of base panels, a rear edge of said base panel being disposed proximate said rear panel, said base plate sloping rearwardly toward said rear panel.

2. The knock-down bookshelf as recited in claim 1, wherein said base plate further comprises at least one cleat affixed to a lower surface thereof substantially perpendicular to right and left side edges of said base plate and positioned substantially centrally along a perpendicular line between said left and said right side edges of said base plate, said cleat having a length substantially equal to a distance between the inside surfaces of said pair of base panels so as to fit snugly therebetween.

3. The knock-down bookshelf as recited in claim 2, wherein said at least one cleat comprises two cleats, a first cleat disposed proximate a front edge of said base plate and a second cleat disposed proximate a rear edge of said base plate.

4. The knock-down bookshelf as recited in claim 1, wherein said front notch in each of said pair of base panels extends to a depth substantially one half of the height of said front edge of said base panels and wherein said rear notch in each of said pair of base panels extends to a depth approximately one half of the length of said rear edge of said base panels.

5. The knock-down bookshelf as recited in claim 4 wherein said bottom edge of said front panel and said bottom edge of said rear panel are substantially co-planer with said bottom edges of said pair of planar base panels.

6. The knock-down bookshelf as recited in claim 1, wherein said top edge of said front panel is substantially co-planer with a top surface of said base plate.

7. The knock-down bookshelf as recited in claim 1, wherein said top edge of said front panel is substantially co-planer with a bottom surface of said base plate.

8. The knock-down bookshelf as recited in claim 1, wherein said top edge of said front panel extends above a top surface of said base plate.

9. The knock-down bookshelf as recited in claim 1, wherein said rear panel extends above an upper surface of said base plate a sufficient height to support a book disposed on said base plate and leaning against said rear panel.

10. The knock-down bookshelf as recited in claim 1, wherein said front notches in said pair of planar base panels and said right and said left notches in said lower edge of said front panel each have a depth substantially equal to one half the height of said front edges of said pair of base panels.

11. The knock-down bookshelf as recited in claim 1, wherein the combined depth of one of said front notches in said pair of planar base panels and the depth of one of said right and said left notches in said lower edge of said front panel is substantially equal to the height of said front edges of said pair of base panels.

12. The knock-down bookshelf as recited in claim 1, wherein said rear notches in said pair of planar base panels and said right and left notches in the lower edge of said rear panel each have a depth substantially equal to one half the height of said rear edges of said pair of base panels.

13. The knock-down bookshelf as recited in claim 1, wherein the combined depth of one of said rear notches in said pair of planar base panels and the depth of one of said right and said left notches in said lower edge of said rear panel is substantially equal to the height of said rear edges of said pair of base panels.

* * * * *